US008899872B2

(12) United States Patent
Triplett et al.

(10) Patent No.: US 8,899,872 B2
(45) Date of Patent: Dec. 2, 2014

(54) THERMOPLASTIC DIE BOX WITH QUICK HEIGHT ADJUSTMENT MECHANISM

(75) Inventors: Thomas L. Triplett, Rockford, MN (US); Steven H. Fredrickson, Minneapolis, MN (US); Charles W. Dawson, Big Lake, MN (US); Christopher A. Lins, Crystal, MN (US); Barry W. Mattson, Elk River, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 13/980,155

(22) PCT Filed: Jan. 19, 2012

(86) PCT No.: PCT/US2012/021838

§ 371 (c)(1),
(2), (4) Date: Jul. 17, 2013

(87) PCT Pub. No.: WO2012/100029

PCT Pub. Date: Jul. 26, 2012

(65) Prior Publication Data

US 2013/0294831 A1 Nov. 7, 2013

Related U.S. Application Data

(60) Provisional application No. 61/434,055, filed on Jan. 19, 2011.

(51) Int. Cl.

| | |
|---|---|
| ***E01C 23/16*** | (2006.01) |
| ***E06B 7/16*** | (2006.01) |
| ***E01C 23/20*** | (2006.01) |

(52) U.S. Cl.
CPC . *E06B 7/16* (2013.01); *E01C 23/16* (2013.01); *E01C 23/20* (2013.01); *E01C 23/206* (2013.01)
USPC ..... 404/94; 404/101

(58) Field of Classification Search
CPC ..... E01C 23/16; E01C 23/22; E01C 23/206
USPC ..... 404/94, 93, 101; 401/1; 239/1
See application file for complete search history.

(56) References Cited

U.S. PATENT DOCUMENTS

| | | | | |
|---|---|---|---|---|
| 3,070,822 | A * | 1/1963 | Lipkins | 401/48 |
| 3,964,835 | A | 6/1976 | Eigenmann | |
| 4,802,788 | A * | 2/1989 | Smith | 404/94 |

(Continued)

OTHER PUBLICATIONS

International Search Report and Written Opinion of the Patent Cooperation Treaty Office in application No. PCT/US2012/021838 dated Jun. 20, 2012.

*Primary Examiner* — Raymond W Addie
(74) *Attorney, Agent, or Firm* — Kinney & Lange, P.A.

(57) ABSTRACT

A screed die box includes a screed die bucket, a screed die box gate, a screed die box lever, a screed plate, and a positioning member. The screed die box gas is slidably connected at the bottom of the screed die bucket. The screed die box lever is rotatably connected to the screed die bucket and the screed die box gate for sliding the screed die box gate between an open position and a closed position. The screed plate is slidably connected along an aft side of the screed die bucket and includes a positioning aperture. The positioning member is located in the screed die bucket and engages the screed plate, the positioning member sliding the screed plate as the positioning member is rotated.

18 Claims, 8 Drawing Sheets

(56) References Cited

U.S. PATENT DOCUMENTS 4,974,990 A * 12/1990 Anderson et al. ..... 404/94
5,302,207 A * 4/1994 Jurcisin ..... 118/713
6,227,454 B1 * 5/2001 Wolf et al. ..... 239/1
6,478,507 B2 11/2002 Schroeder et al.
2009/0087263 A1 4/2009 Martinez et al.
2010/0135723 A1 6/2010 Hicks

* cited by examiner

THERMOPLASTIC DIE BOX WITH QUICK HEIGHT ADJUSTMENT MECHANISM

BACKGROUND

The present invention relates generally to pavement marking, and more particularly to the adjustment mechanism for a thermoplastic die box Alkyd and hydrocarbon thermoplastics are commonly used to mark pavement surfaces with visible lines and symbols such as lane dividers and guide lines. In particular, thermoplastics provide a durable alternative to pavement painting, and are commonly used to mark street intersections, parking lots, and other high-traffic pavement surfaces from which paint would quickly wear away.

Thermoplastics are conventionally applied to pavement surfaces using a mobile applicator comprising a heated reservoir or kettle, and an application screed die. Melted thermoplastic is dispensed from the kettle at a controlled rate and applied in a thin layer atop pavement surfaces with the screed die. Some applicators further comprise secondary burners which heat secondary reservoirs or screed die. Many applicators burn pressurized gas, such as propane and butane, at secondary burners and to heat applicator kettles. Manually driven and self-powered applicators are both relatively common, and some applicators can be attached to and driven by vehicles.

Conventional thermoplastics must be brought to melt temperatures of 177 to 250° C. (350 to 480° F.) prior to application. Existing systems use a central mixer-melter to bring thermoplastics to these temperatures. Once melted, a load of thermoplastic from the central mixer-melter is transferred to the kettle of a mobile applicator for pavement marking. The applicator kettle is heated to prevent thermoplastic from resolidifying before it is applied to the pavement surface. Often, a single central mixer-melter may service a plurality of applicators on a job site.

In general, governmental regulations determine the thickness of the thermoplastic being applied to the road surface. In order to achieve this predetermined thickness, the thickness of the dispensed material must be changed. In addition, other environmental factors can change the application parameters (such as ambient temperature and surface roughness). In order to compensate for such variables, the screed die box needs to be variable. But the adjustments will need to take place in the field where there may be adverse conditions and/or limited mechanical facilities.

SUMMARY

In one embodiment of the present invention, a screed die box includes a screed die bucket, a screed die box gate, a screed die box lever, a screed plate, and a positioning member. The screed die box gate is slidably connected at the bottom of the screed die bucket. The screed die box lever is rotatably connected to the screed die bucket and the screed die box gate for sliding the screed die box gate between an open position and a closed position. The screed plate is slidably connected along an aft side of the screed die bucket and includes a positioning aperture. The positioning member is located in the screed die bucket and engages the screed plate, the positioning member sliding the screed plate as the positioning member is rotated.

In another embodiment of the present invention, a mobile applicator includes a frame, a kettle, wheels, and a screed die box. The kettle is attached to the frame and is for holding a thermoplastic material. The wheels are rotatably connected to the frame. The screed die box is connected to the frame and is for dispensing the thermoplastic material. The screed die box includes a screed die bucket, a screed plate at the rear of the screed die bucket, and a positioning member. The positioning member is located in the screed die bucket and engages the screed plate, the positioning member sliding the screed plate as the positioning member is rotated.

DETAILED DESCRIPTION

Figure 1:
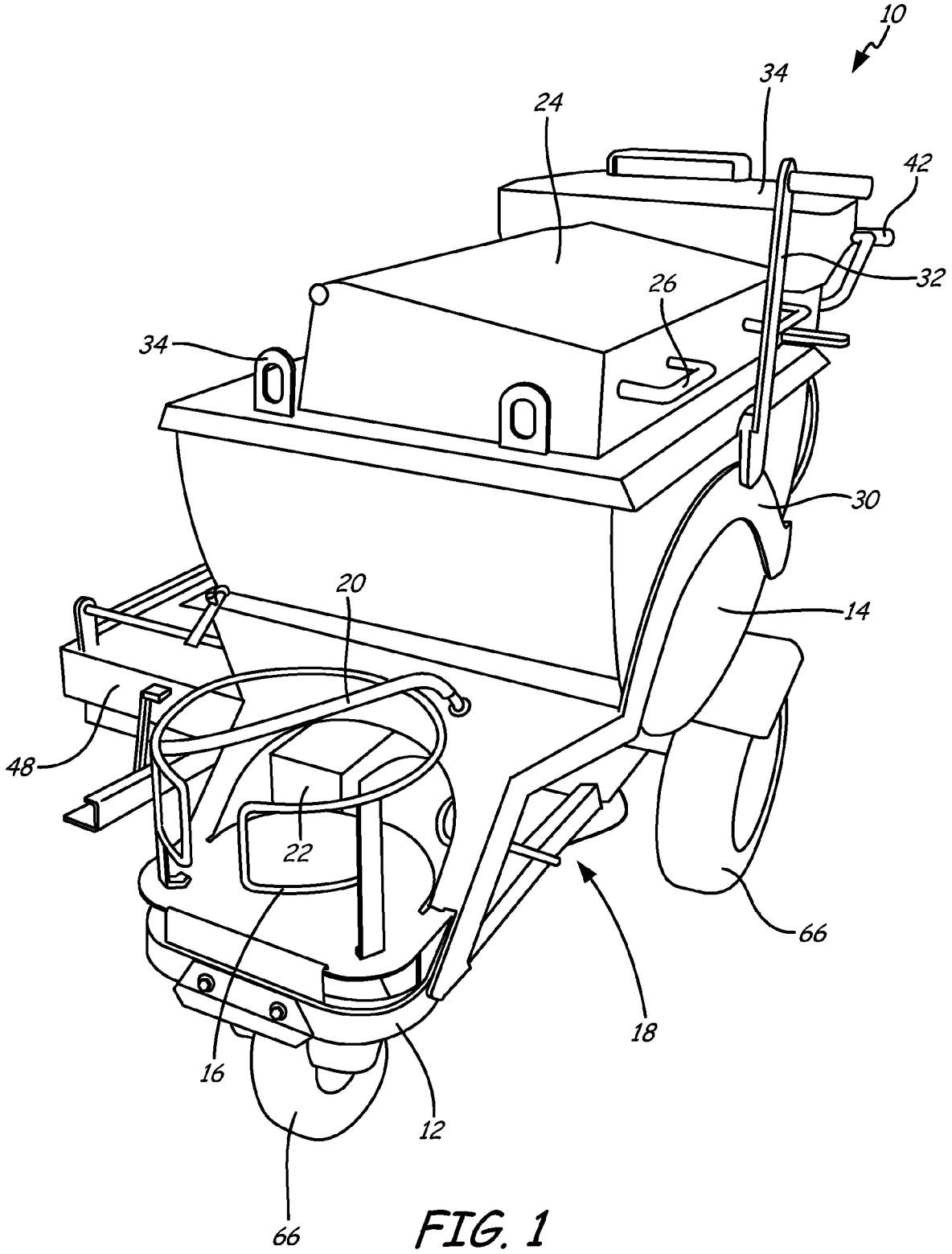
FIG. 1 is a first perspective view of a mobile applicator of the present invention.
Figure 2:
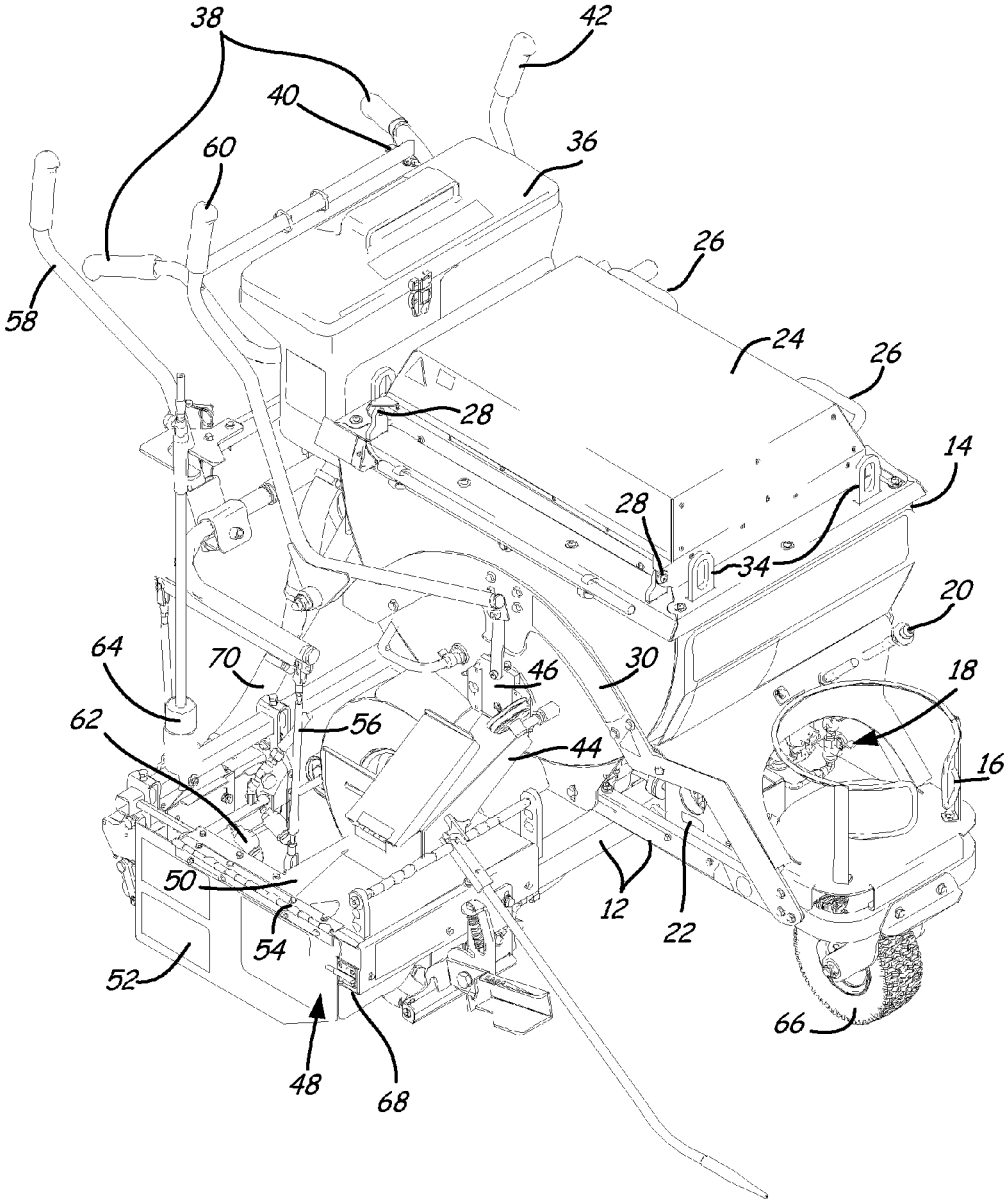
FIG. 2 is a second perspective view of the mobile applicator.

FIGS. 1 and 2 are perspective views of mobile applicator 10 that will be discussed simultaneously. Mobile applicator 10 comprises frame 12, kettle 14, gas tank cradle 16, gas system 18 (with gas tank hookup 20 and gas safety valve 22), kettle lid 24 (with lid handles 26 and lid hinges 28), kettle supports 30, agitator arm 32, lifting eyes 34, bead reservoir 36, push bar 38 (with handbrake 40), agitator lever 42, chute 44, gate valve 46, screed enclosure 48 (with screed enclosure top 50 and screed shroud door 52 connected at shroud door hinges 54), screed actuator link 56, screed actuator lever 58, gate valve lever 60, screed box burners 62, hand torch 64, wheels 66, shroud door latch 68, and bead tube 70.

Mobile applicator 10 is a tool capable of marking pavement lines by melting and then applying thermoplastic a pavement surface. Mobile applicator 10 includes frame 12 which provides support for other components of mobile applicator 12. Frame 12 may, for instance, be comprised of a framework of aluminum and/or steel beams, tubes, and struts. Gas tank cradle 16 is attached to frame 12 at the forward end of frame 12. Gas tank cradle 16 is a holding structure sized to retain a tank of propane, butane, or other appropriate combustible gas. Wheels 66 are rotatably attached to the bottom of frame 12 and allow mobile applicator 10 to move along pavement. In the illustrated embodiment, mobile applicator 10 includes three wheels 66: a single front wheel which swivels and provides directional control, and two rear wheels which track behind the front wheel. Push bar 38 is attached at the aft of frame 12 and includes handbrake 40. Push bar 38 allows a user to propel mobile applicator 10, and handbrake 40 allows the user to stop applicator 10, such that the user can direct where the pavement lines are made. One skilled in the art can appreciate that although directional terms such as "forward", "aft", "bottom", "top", "right side", and "left side" have been used in describing this invention, but such terms are merely relational descriptors of the illustrated embodiments shown herein.

Mounted to the top of frame 12 is kettle 14, which is a receptacle that is heated to melt granular thermoplastic for application to pavement surfaces. In the illustrated embodiment, kettle 14 is a substantially hemi-cylindrical receptacle heated from below by a plurality of gas burners. Kettle 14 may, for instance, be formed of aluminum. Kettle 14 is attached to frame 12 via kettle supports 30, which are rigid struts or surfaces formed, for instance, of steel or aluminum.

Kettle lid 24 covers the open top of kettle 14 and prevents molten thermoplastic and thermoplastic vapor and heat from escaping from kettle 14 during operation. Kettle lid 24 can be opened and closed with lid handles 26, which are attached to the left side of kettle lid 24. In some embodiments, kettle 14 may include latches which allow kettle lid 24 to be locked shut. Kettle lid 24 is connected to kettle 14 via lid hinges 28 which are on the right side of kettle lid 24 (opposite of lid handles 26). Lid hinges 28 may be any sort of conventional hinge selected for heat resilience and resistance to fouling when exposed to melted thermoplastic. In addition, kettle 14 includes agitator arm 32 which is connected to a plurality of agitators inside kettle 14 used to stir the molten thermoplastic.

Also attached to the top of kettle 14 are lifting eyes 34. Lifting eyes 34 are attachment points that allow mobile applicator 10 to be hoisted into position or loaded onto or off of a transportation vehicle. In the illustrated embodiment, lifting eyes 34 are tabs with holes which extend from the top surface of kettle 14, but a person skilled in the art will recognize that lifting eyes 34 may generally be any sort of load-bearing anchors for a hoist or crane, and could, for instance, be located on frame 12, instead.

At the bottom right side of kettle 14 is gate valve 46. Gate valve 46 is positioned between the interior of kettle 14 to chute 44. Chute 44 is a rigid, heat-resistant chute or trough which guides molten thermoplastic from kettle 14 to the screed die box. Chute 44 is comprised of a heat-resistant material including, but not limited to, aluminum or steel.

As stated previously, gas tank cradle 16 holds a tank of combustible gas (not shown), and gas from this tank is utilized by gas system 18. Gas system 18 is largely located beneath kettle 14 and kettle supports 30, and is anchored to frame 12. Gas system 18 includes gas hookup 20, a fluid connection which receives gas from a tank at gas tank cradle 16. Gas system 18 also includes gas safety valve 22, and a plurality of other valves and gas distribution tubes. Gas safety valve 22 is an electrically actuated multi-path valve which controls gas flow to the pilot burners and main burners heating kettle 14. Gas system 18 provides combustible gas to burners which heat kettle 14, and to screed box burners 62 and hand torch 64. Hand torch 64 is a handheld burner which can be used by a human operator to touch up or remove thermoplastic applied using mobile applicator 10 and is therefore located at the aft of mobile applicator 10. In addition, screed box burners 62 are connected to gas system 18.

Screed enclosure 48 is anchored to frame 12 at the bottom right side of frame 12. Screed enclosure 48 includes screed enclosure top 50 and screed shroud door 52. Screed enclosure 48 surrounds screed box burners 62 and the screed die box (see FIG. 3, below). Screed enclosure top 50 partially covers the screed die box, and screed shroud door 52 is connected to screed enclosure top 50 by shroud door hinges 54, such that screed shroud door 52 can be pivoted upward from door hinges 54 to reach, remove, or insert the screed die box. Screed shroud door 52 is secured to frame 12 by shroud door latch 68, which holds shroud door 52 in the depicted (closed) position during operation of mobile applicator 10. Screed enclosure 48 shields the screed die box from wind and debris and conversely shields the operator from the molten thermoplastic therein.

In order to operate mobile applicator 10, a user ignites the pilot burners and main burners under kettle 14. Then the user opens kettle lid 24 and deposits a sack of granular thermoplastic atop heat exchanger plenums located inside kettle 14. The sack itself is formed of a meltable thermoplastic material, so heat from main burners 116 melts the sack and the granules. The user can then rotate agitator arm 32 back and forth across a substantially 180° range, thereby sweeping the agitators through the interior of kettle 14 so as to mix the thermoplastic as it melts. Alternatively, the user can attach agitator arm 32 to agitator lever 42, allowing the user to move agitator arm 32 from the aft of mobile applicator 10.

Once the thermoplastic is uniformly melted, the user can pull gate valve lever 60, which opens gate valve 36. Opening gate valve 36 allows thermoplastic from kettle 14 to flow down chute 44 into the screed die box (shown in FIG. 3). Screed box burners 62 heat the screed die box, allowing the thermoplastic to remain molten as it is dispensed. In addition, light reflective beads are commonly used to provide increased visibility to thermoplastic stripes, for some applications. These beads, which are usually formed of glass, are deposited on freshly applied molten thermoplastic. Some embodiments of mobile applicator 10 include bead reservoir 36 (located at the top aft of mobile applicator 10), which is a receptacle for storing such glass beads. Bead tube 70 carries beads from bead reservoir 36 to screed enclosure 48, allowing beads to be deposited as thermoplastic is applied.

The components and configuration of mobile applicator 10 as shown in FIGS. 1 and 2 allow for a sack of thermoplastic granules to be transformed into a pavement line. This occurs by mobile applicator 10 melting the thermoplastic in kettle 14, transferring the melted thermoplastic into a screed die (shown in FIG. 3) via gate valve 46 and chute 44, and dispensing the molten thermoplastic onto the pavement. A pavement line is formed as the user propels mobile applicator 10.

FIGS. 1 and 2 depict one embodiment of the invention, to which there are alternatives. For example, mobile applicator 10 can include mounting points such that mobile applicator 10 can be attached to a motor vehicle. In such an embodiment, the motor vehicle pushes and/or pulls mobile applicator 10 in order to direct where the pavement lines are made.

Figure 3:
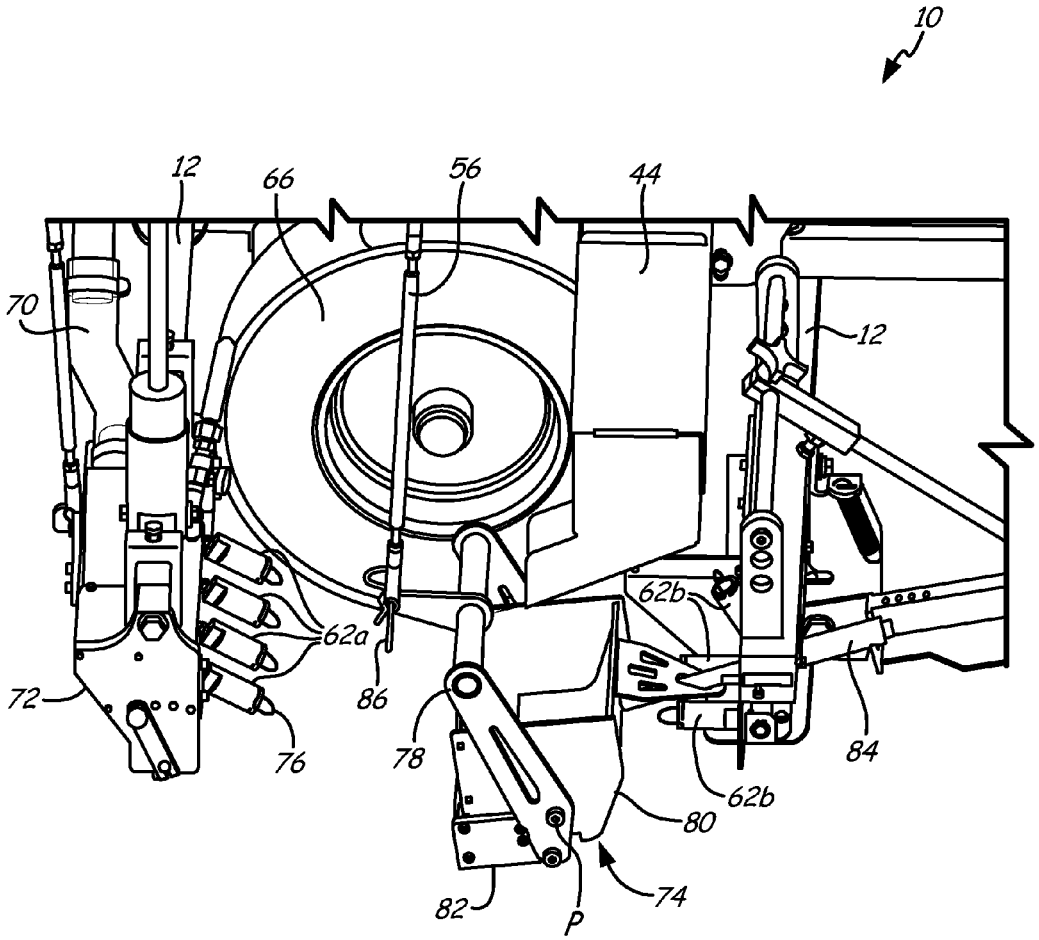
FIG. 3 is a perspective view of a screed die box of the mobile applicator.

FIG. 3 provides a close-up view of die box 74 and surrounding components of mobile applicator 10, with screed enclosure 48 removed for increased visibility. FIG. 3 depicts frame 12, chute 44, screed actuator link 56, screed burners 62 (including four aft screed burners 62*a* and three fore burners 62*b*), wheel 66, bead tube 70, bead dispenser 72, screed die box 74, and flame indicators 76. Screed die box 74 comprises screed die box lever 78, screed die box bucket 80, screed die box gate 82, screed die box anchor 84, retention pin 86, and pivot point P.

As stated above with respect to FIGS. 1 and 2, screed die box 74 is positioned beneath chute 44 in order to receive molten thermoplastic from chute 44. Screed die box 74 is primarily comprised of screed die bucket 80, a five-sided container open on top to receive thermoplastic from chute 44. Screed die bucket 80 is anchored relative to other components of mobile applicator 10 by screed die box anchor 84, which is welded to or integrally formed on the forward side of bucket 80. In the illustrated embodiment, screed die box anchor 84 is an elongate post which extends through and can be locked into place relative to frame 12. Screed die box anchor 84 can be locked in place to frame 12 anywhere along the length of screed die box anchor 84, allowing the position of screed die box 74 to be adjusted for different applications. A person skilled in the art will recognize that screed die box 74 could alternatively be anchored to frame 12 by other flexible or inflexible means, and that screed die box anchor 84 could accordingly take other forms which equivalently allow screed die box 74 to be secured to frame 12. Screed die box anchor 84 may double as a handle used by operators to install, remove, and transport screed die box 74.

Figure 4A:
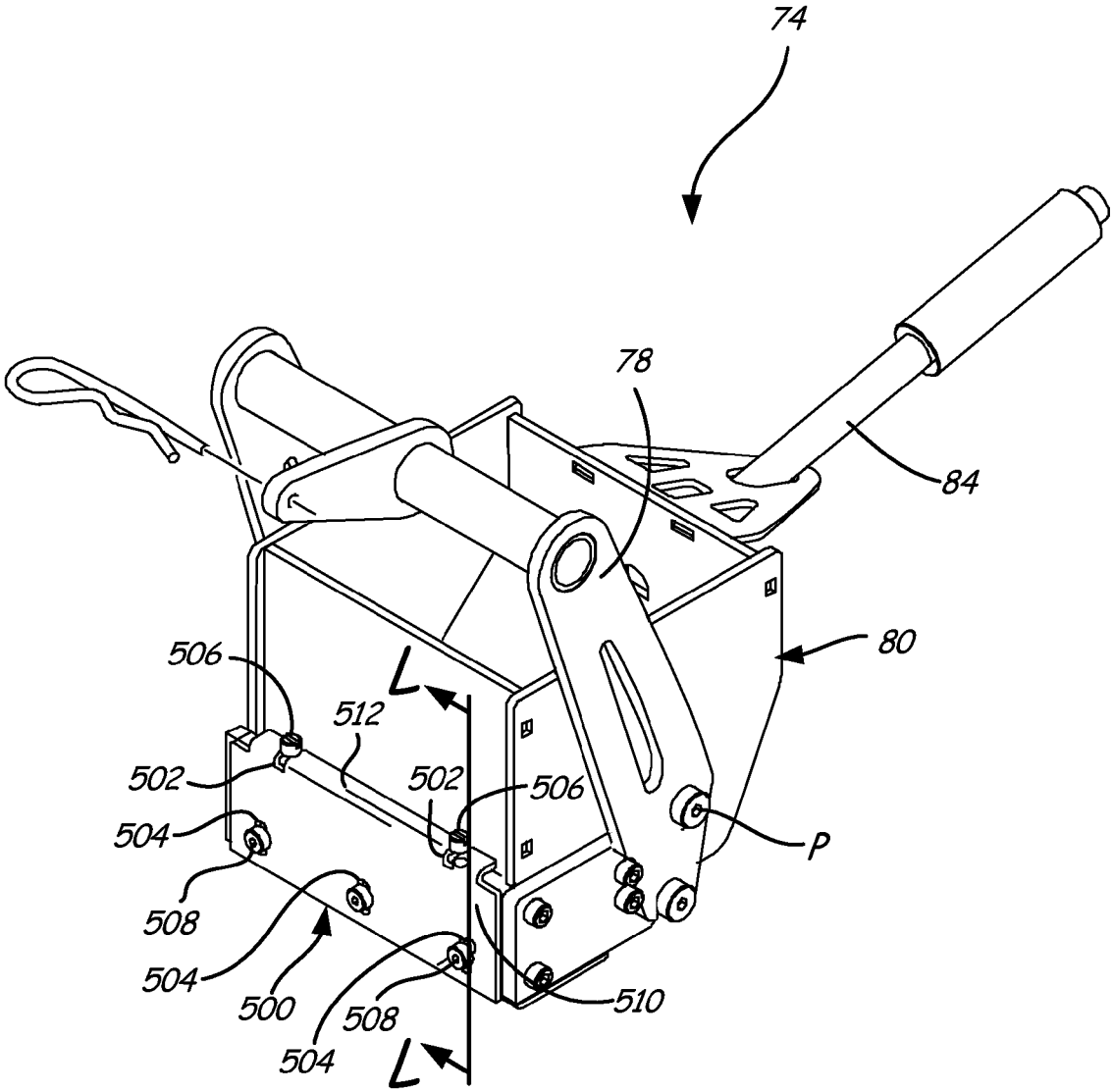
FIG. 4*a* is an assembled perspective view of the screed die box.
Figure 4B:
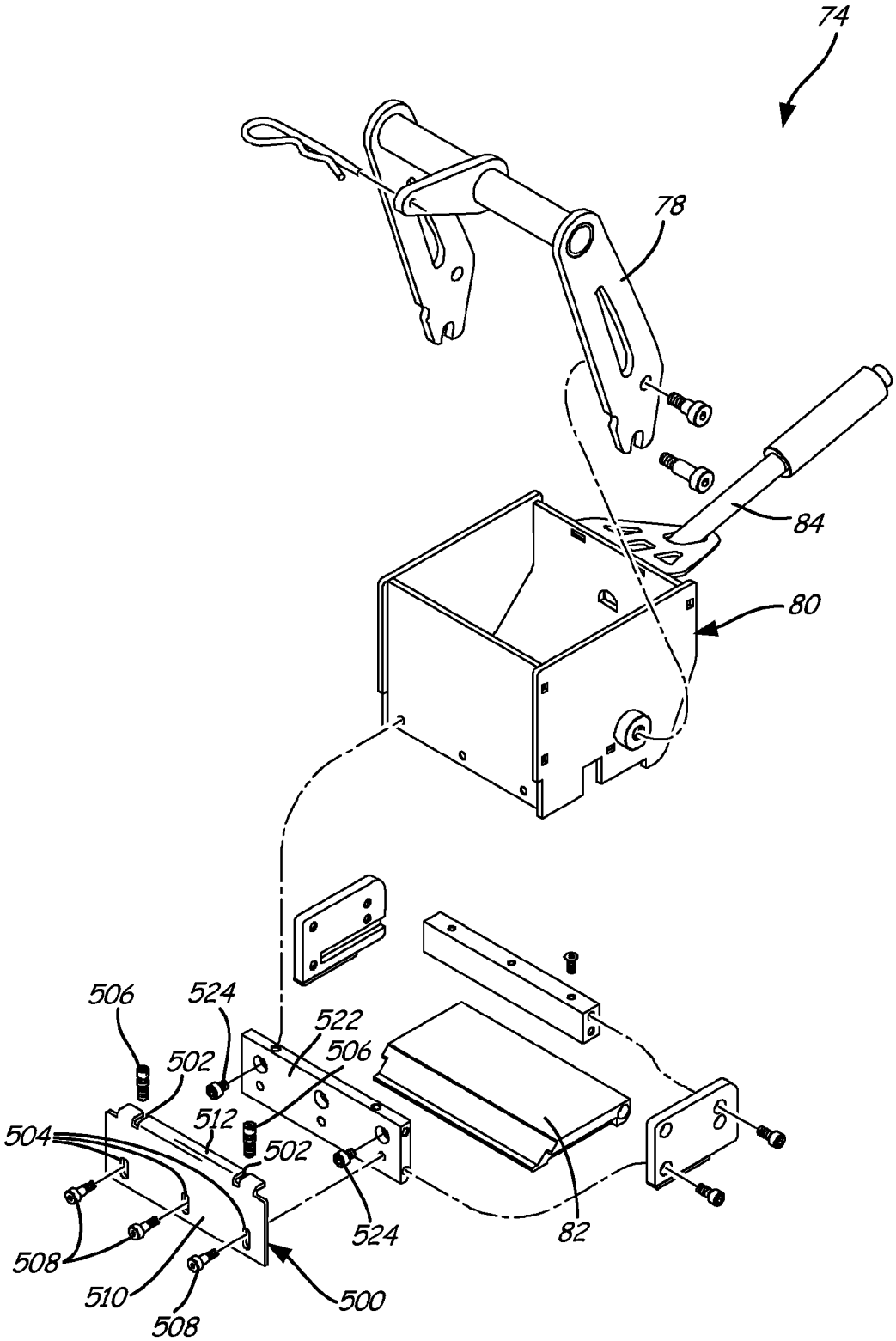
FIG. 4*b* is an exploded perspective view of the screed die box.

Screed die box lever 78 attaches to screed die box gate 82 (shown in FIG. 4*b*). Screed die box gate 82 is a slidable plate along the bottom of screed die bucket 80. Screed die box lever 78 is detachably attached to screed actuator link 56 by means of retention pin 86, and is fastened to screed die box gate 82. When screed actuator lever 58 (shown in FIG. 2) is pulled, screed actuator link 56 is forced downward and a torque is applied to screed die box lever 78. Screed die box lever 78 then rotates around pivot point P, which exerts a aftward force on screed die box gate 82. Screed die box gate 82 shifts aftward, opening a gap in the bottom of screed die bucket 80 through which thermoplastic material can flow. On the other hand, when screed actuator lever 58 (shown in FIG. 2) is pushed, screed actuator link 56 is forced upward and a torque is applied to screed die box lever 78. Screed die box lever 78 then rotates around pivot point P, which exerts a forward force on screed die box gate 82. Screed die box gate 82 shifts aftward, closing the gap in the bottom of screed die bucket 80. Screed die box 74 may have a plurality of distinct embodiments with different dimensions and additional features for use in different applications, any of which may be freely swapped in and out of mobile applicator 10 by fastening screed die box 74 to frame 12 using screed die box anchor 84, and attaching screed die box lever 78 to screed actuator link 56 with retention pin 86.

Also shown in FIG. 3, bead dispenser 72 is attached to frame 12 and supports aft screed burners 62*a*. Bead dispenser 72 receives and deposits visibility-enhancing beads from bead tube 70, as understood in the art. In addition, fore burners 62*b* are supported by frame 12 and are located forward of screed die box 74.

Screed die box 74 is heated by screed burners 62, to ensure that thermoplastic deposited in screed die box 74 from chute 44 remains molten during the application process. As stated previously, all screed burners 62 receive combustible gas from gas system 18. Screed burners 62 include aft screed burners 62*a*, which are directed to an aft portion of screed die box 74, and fore screed burners 62*b*. Although the embodiment of mobile applicator 10 depicted in FIG. 3 includes four aft screed burners 62*b* and three fore screed burners, a person skilled in the art will understand that the number and placement of screed burners may be varied without departing from the spirit of the present invention. In particular, some embodiments of mobile applicator 10 may not include aft screed burners 76. Alternatively, one or both of aft and fore screed burners 62*a* and 62*b*, respectively, may be modular components which may be connected to gas system 18 if and when desired. As shown in FIG. 3, two of fore screed burners 62*b* are directed to a fore portion of screed die box 74 near where screed die box anchor 84 attaches to screed die box bucket 80, while a third screed burner 62*b* is directed at chute 44 to prevent thermoplastic from solidifying in chute 44. As depicted, all screed burners are ignited manually, although a person skilled in the art will recognize that automatic ignition tools such as electrical sparkers may be utilized instead.

The components and configuration of mobile applicator 10 as shown in FIG. 3 allow for molten thermoplastic to be applied to pavement. Screed burners 62 heat die box 74 and chute 44, allowing molten thermoplastic to flow smoothly from kettle 14 into screed die box 74 and maintaining thermoplastic in screed die box 74 in a molten state. By pulling screed actuator lever 58 (shown in FIG. 2), an operator can deposit molten thermoplastic from screed die box 74 onto a pavement surface.

FIG. 4*a* shows a perspective view of an assembled screed die box 74. FIG. 4*b* shows a perspective view of an exploded screed die box 74. FIGS. 4*a* and 4*b* will be discussed simultaneously. Screed die box 74 includes screed die box lever 78, screed die bucket 80, screed die box gate 82, screed die box anchor 84, screed plate 500, positioning screws 506, retaining screws 508, screed plate mount 522, and mount screws 524. Screed plate 500 itself includes including positioning apertures 502, retaining slots 504, first screed portion 510, second screed portion 512, and pivot point P.

As stated previously, screed die box anchor 84 is attached to the forward side of screed die bucket 80. Screed die box lever 78 is rotates about pivot point P (which is its attachment point to screed die bucket 80), and screed die box lever 78 is slidably attached to screed die box gate 82. Screed die box gate 82 is slidably connected to the bottom side of screed die bucket 80.

In the illustrated embodiment, attached to the aft side of screed die bucket 80 by mount screws 524 is screed plate mount 522. One skilled in the art can appreciate that screed plate mount 522 can be an integral part to screed die bucket 80, and should be considered as such for the present purposes. In addition, screed plate 500 is slidably attached to the aft side of screed die bucket 80 with positioning screws 506 and retaining screws 508. More specifically, retaining screws 508 are positioned in retaining slots 504 in first screed portion 510 that extends substantially parallel to the aft side of screed die bucket 80. In addition, positioning screws 506 are positioned in positioning apertures 502 in second screed portion 512 that extends substantially perpendicular to first screed portion 510. Positioning apertures 502 are open-ended slots that extend through the forward side of screed plate 500. Both positioning screws 506 and retaining screws 508 are also located in screed die bucket 80 insofar as screws 506-508 are screwed into threaded holes in screed die bucket 80.

The components and configuration of screed die box 74 as shown in FIG. 4 allows for the dispensing of melted thermoplastic material when a user pulls on screed actuator lever 58 (shown in FIG. 2). This occurs by screed die box lever 78 rotating, which slides screed die box gate 82 forward. This creates opens flowpath for the thermoplastic material out of the bottom rear of screed die bucket 80. Because screed plate 500 is positioned in this pathway, the position of screed plate 500 affects the flow leaving screed die bucket 80.

Figure 5A:
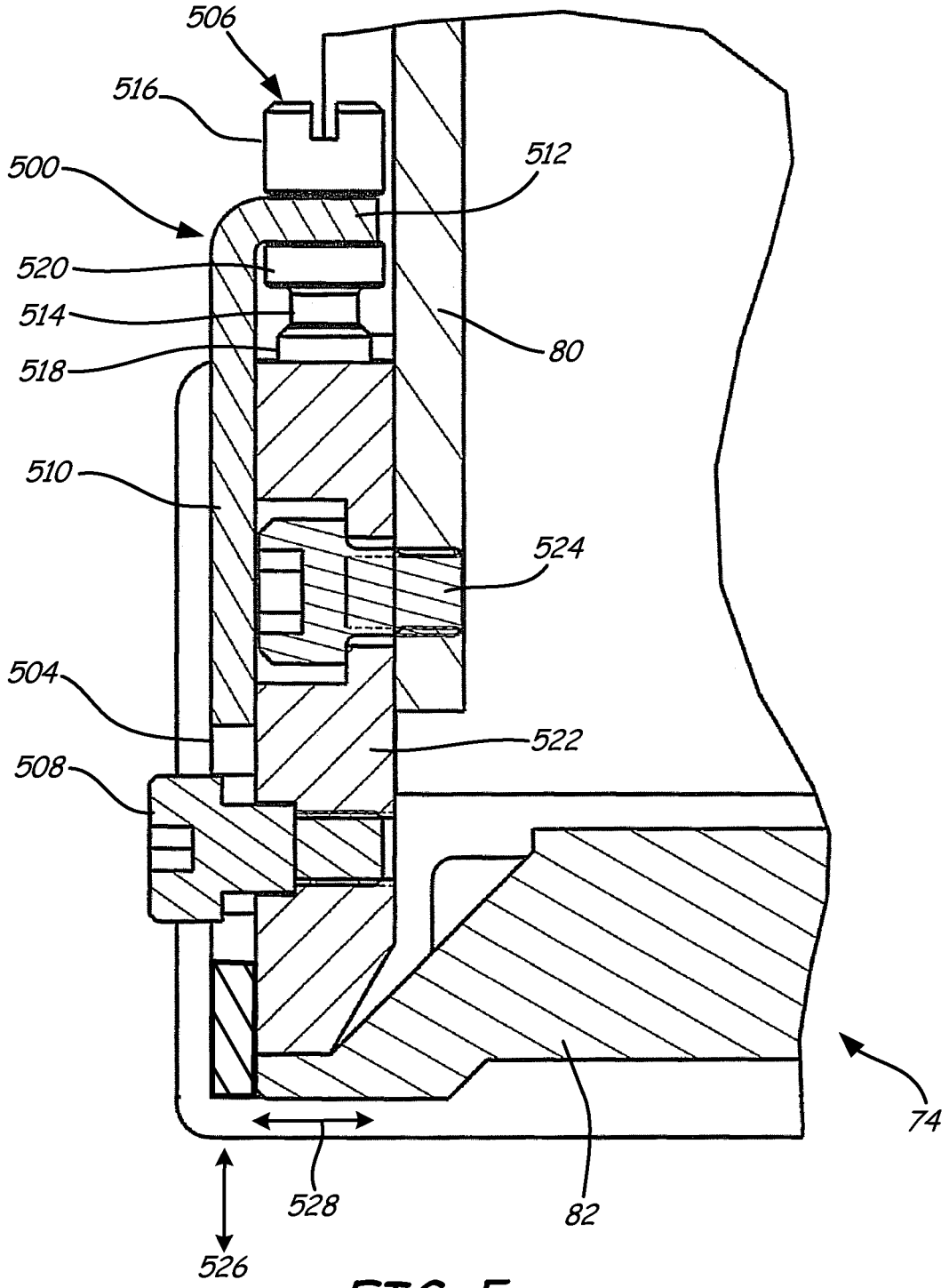
FIG. 5*a* is a cross-sectional view of the screed die box along line L-L in FIG. 4*a* with a screed plate fully down and a screed die box gate fully closed.
Figure 5B:
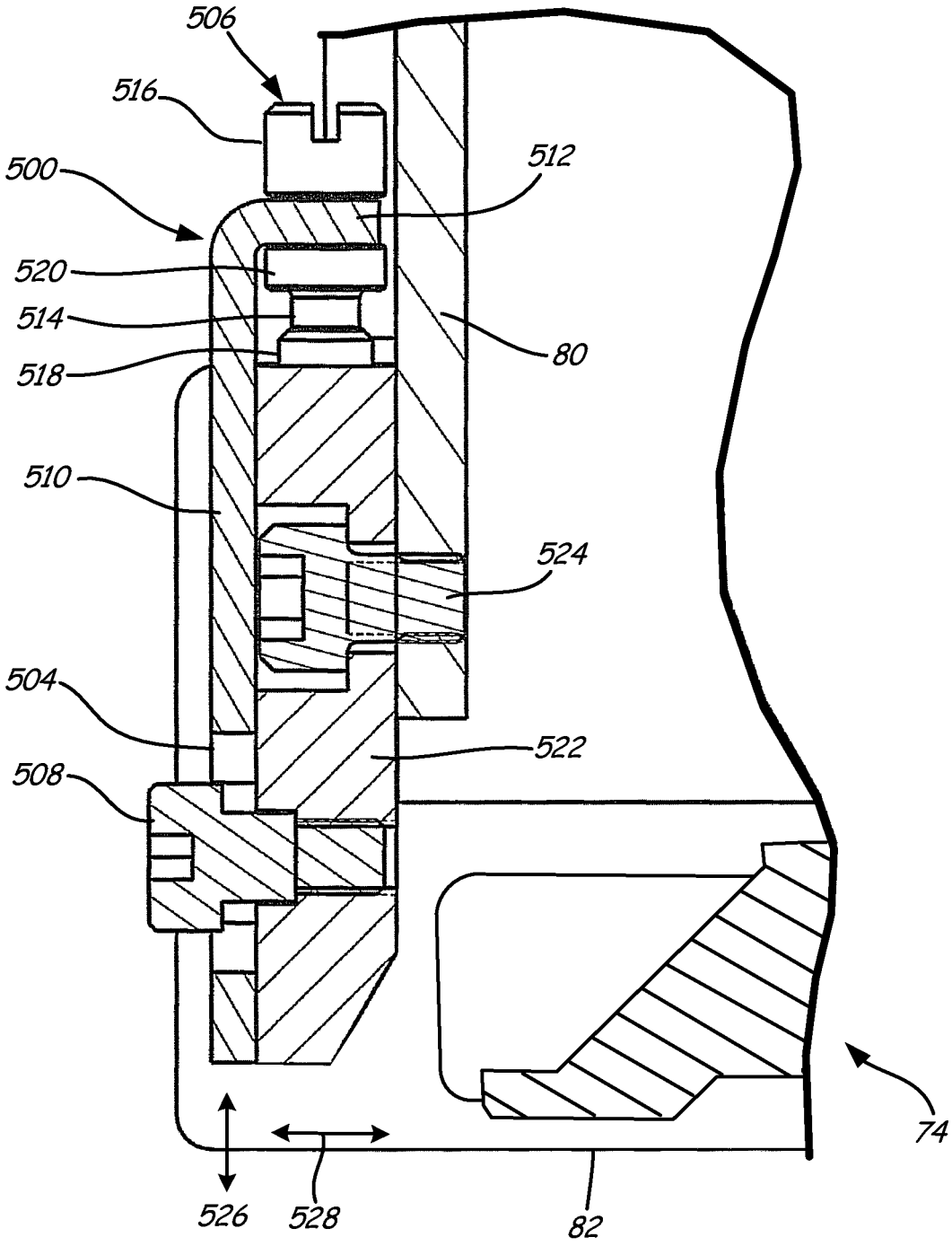
FIG. 5*b* is a cross-sectional view of the screed die box along line L-L in FIG. 4*a* with the screed plate fully up and the screed die box gate fully opened.

FIG. 5*a* shows a cross-sectional view of screed die box 74 along line L-L in FIG. 4*a* with screed plate 500 fully down and screed die box gate 82 fully closed. FIG. 5*b* shows a cross-sectional view of screed die box 74 along line L-L in FIG. 4*a* with screed plate 500 fully up and screed die box gate 82 fully opened.

Positioning screw 506 includes positioning screw shaft 514, at one end of which is positioning screw head 516 and at the opposite end of which is positioning screw thread 518. Along the length of positioning screw shaft 514 and spaced apart from positioning screw head 516 is positioning screw shoulder 520. As suggested previously, positioning screw thread 518 of positioning screw 506 is threaded into the aft side of screed die bucket 80 at screed plate mount 522. Thereby, positioning screw 506 can be elevated or descended relative to screed die bucket 80 because of the threaded hole in screed plate mount 522 that is substantially parallel to the aft side of screed die bucket 80.

Retaining screw 508 captures screed plate 500 against screed plate mount 522 by being positioned in retaining slot 504 and having a head that is wider than the width of retaining slot 504. But because retaining slot 504 is taller than the shaft of retaining screw 508, screed plate can move substantially parallel to the aft side of screed die bucket 80.

Positioning screw 506 engages screed plate 500 by having positioning screw shaft 514 in positioning aperture 502 (shown in FIG. 4). This is possible because positioning screw shaft 514 is smaller than positioning aperture 502. But positioning screw head 516 and positioning screw shoulder 520 are larger than positioning aperture 502. Because screed plate 500 is captured between positioning screw head 516 and positioning screw shoulder 520, the elevation of positioning screw 506 in screed plate mount 522 determines the position of screed plate 500.

In FIG. 5*b*, screed plate 500 is shown in fully up position at which it functions. As positioning screw 506 is screwed farther into screed plate mount 522, screed plate 500 moves along screed plate direction 526 until it reaches the lower extent of its travel. This fully down position of screed plate 500 is shown in FIG. 5*a*. In the illustrated embodiment, the total travel distance shown is 3.81 mm (0.150 inches).

In FIG. 5*a*, screed die box gate 82 is in the closed position. In this position, screed die box gate 82 prevents flow by contacting the aft side of screed die bucket 80 at screed plate mount 522. As stated previously, when a user causes screed die box gate 82 to move to its opened position along box gate displacement direction 528. This opened position is shown in FIG. 5*b* and allows melted thermoplastic material to flow rearward and downward between screed plate mount 522 and screed die box gate 82. The material then flows past screed plate 500, which restricts the flow to a degree dictated by the position of screed plate 500. Of course amount of interference can be adjusted by positioning screw 506, which moves screed plate 500 along screed plate direction 526 which is perpendicular to box gate displacement direction 528.

Figure 6:
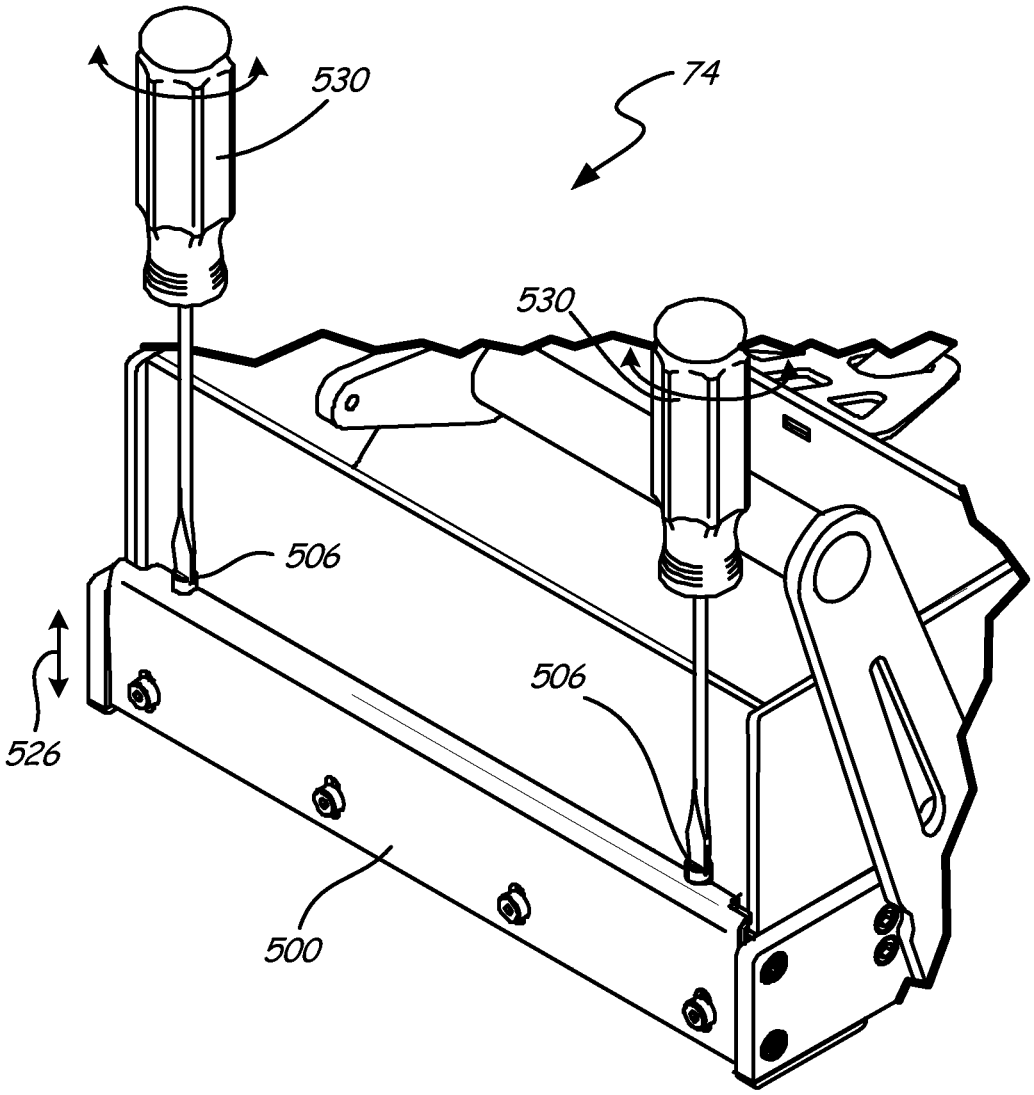
FIG. 6 is a perspective view of the screed plate being adjusted using two screwdrivers.

FIG. 6 shows a perspective view of screed die box 74 with the position of screed plate 500 being adjusted using two screwdrivers 530. The adjustment is performed using two screwdrivers 530. A user simultaneously turns screwdrivers 530 in the same direction the same amount in order to change the elevation of screed plate 500. Because screwdrivers 530 are turning positioning screws 506 with known thread pitches, the user can count the revolutions and know the distance that screed plate 500 has been moved. In the illustrated embodiment, one full turn (360°) of positioning screws 506 yields 1.27 mm (0.050 inches) of movement. Thereby, screed plate can be moved from fully down to fully up with three complete turns of positioning screws 506.

It can be appreciated by one skilled in the art that screed die box 74 can include more or fewer positioning screws 506 than two. In addition, even if there is more than one positioning screw 506, a user can adjust screed plate 500 by alternately turning positioning screws 506 incremental, identical amounts until the desired elevation of screed plate 500 is achieved.

The components and configuration of screed die box 74 as shown in FIGS. 5*a*-5*b* and 6 allow for the of flow of thermoplastic material out of screed die box 74 to be metered. If a change in the amount of restriction is required, screed plate 500 can be adjusted by turning positioning screws 506 using screw driver 530.

It should be recognized that the present invention provides numerous benefits and advantages. For example, screed die box 74 can be adjusted using one or more screwdrivers without disassembling any portion of the unit.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A screed die box comprising:
- a screed die bucket;
- a screed die box gate slidably connected at the bottom of the screed die bucket;
- a screed die box lever rotatably connected to the screed die bucket and the screed die box gate for sliding the screed die box gate between an open position and a closed position;
- a screed plate slidably connected along an aft side of the screed die bucket, the screed plate including a positioning aperture; and
- a positioning member that is located in the screed die bucket that engages the screed plate, the positioning member sliding the screed plate as the positioning member is rotated, the positioning member comprising:
  - a screw shaft;
  - a screw head at one end of the screw shaft; and
  - a screw shoulder positioned along the length of the screw shaft that is spaced apart from the screw head;
  - wherein the positioning member engages the screed plate by having the screed plate positioned between the screw head and the screw shoulder.

2. The screed die box of claim 1, wherein the positioning member is substantially parallel to the aft side of the screed die bucket.

3. The screed die box of claim 1, and further comprising:
- a screed die box anchor attached to a forward side of the screed die bucket.

4. The screed die box of claim 1, wherein the screed plate comprises:
- a first portion that extends substantially parallel to the aft side of the screed die bucket; and
- a second portion that extends substantially perpendicularly to the first portion, the second portion including the positioning aperture.

5. The screed die box of claim 4, and further comprising:
- a retaining slot in the first portion of the screed plate; and
- a retaining screw positioned in the retaining slot and located in the screed die bucket.

6. The screed die box of claim 1, wherein the screed die box gate contacts the aft side of the screed die bucket when the screed die box gate is in the closed position.

7. The screed die box of claim 1, wherein a thermoplastic material enters into the screed die box through the top of the screed die box and exits out of the bottom of the screed die box when the screed die box gate is in the open position.

8. The screed die box of claim 1, wherein the screed die box gate slides generally vertically and the screed plate slides generally horizontally.

9. A mobile applicator comprising:
- a frame;
- a plurality of wheels rotatably connected to the frame;
- a kettle attached to the frame for holding a thermoplastic material; and a screed die box positioned to receive thermoplastic material from the kettle, the screed die box comprising:

a screed die bucket;

a screed plate at the rear of the screed die bucket; and a positioning member that is located in the screed die bucket that engages the screed plate, the positioning member sliding the screed plate as the positioning member is rotated, the positioning member comprising:

a screw shaft;

a screw head at one end of the screw shaft; and a screw shoulder along the length of the screw shaft that is spaced apart from the screw head;

wherein the positioning member engages the screed plate by having the screed plate positioned between the screw head and the screw shoulder.

10. The mobile applicator of claim 9, wherein the screed die box further comprises:

a screed die box gate slidably connected at the bottom of the screed die bucket; and a screed die box lever rotatably connected to the screed die bucket and the screed die box gate for sliding the screed die box gate between an open position and a closed position.

11. The mobile applicator of claim 10, wherein the screed die box gate contacts the aft side of the screed die bucket when the screed die box gate is in the closed position.

12. The mobile applicator of claim 10, wherein thermoplastic material enters into the screed die box through the top of the screed die box and exits out of the bottom of the screed die box when the screed die box gate is in the open position.

13. The mobile applicator of claim 10, and further comprising:

a screed actuator lever attached to the screed die box lever for rotating the screed die box lever.

14. The mobile applicator of claim 9, wherein the positioning member is substantially parallel to the aft side of the screed die bucket.

15. The mobile applicator of claim 9, and further comprising:

a screed die box anchor attached to a forward side of the screed die bucket.

16. The mobile applicator of claim 9, wherein the screed plate comprises:

a first portion that extends substantially parallel to the aft side of the screed die bucket; and a second portion that extends substantially perpendicularly to the first portion, the second portion including the positioning aperture.

17. The mobile applicator of claim 14, and further comprising:

a retaining slot in the first portion of the screed plate; and a retaining screw positioned in the retaining slot and located in the screed die bucket.

18. The mobile applicator of claim 9, and further comprising:

a chute connected to a side of the kettle near a bottom of the kettle;

wherein the screed die box is positioned beneath the chute.

* * * * *